US012446656B2

(12) United States Patent
Tribus

(10) Patent No.: US 12,446,656 B2
(45) Date of Patent: Oct. 21, 2025

(54) DAMPING ELEMENT FOR A SHOE

(71) Applicant: CHRISTOPH TRIBUS LAUFSCHUH WERKSTATT VGMBH, Meran (IT)

(72) Inventor: Christoph Tribus, Meran (IT)

(73) Assignee: CHRISTOPH TRIBUS LAUFSCHUH WERKSTATT VGMBH, Meran (IT)

( * ) Notice: Subject to any disclaimer, the term of this patent is extended or adjusted under 35 U.S.C. 154(b) by 180 days.

(21) Appl. No.: 17/919,662

(22) PCT Filed: Apr. 20, 2021

(86) PCT No.: PCT/EP2021/060284

§ 371 (c)(1),
(2) Date: Dec. 8, 2022

(87) PCT Pub. No.: WO2021/214088

PCT Pub. Date: Oct. 28, 2021

(65) Prior Publication Data

US 2023/0157408 A1 May 25, 2023

(30) Foreign Application Priority Data

Apr. 20, 2020 (DE) ..... 10 2020 110 724.2

(51) Int. Cl.
*A43B 13/18* (2006.01)

(52) U.S. Cl.
CPC ..... *A43B 13/183* (2013.01)

(58) Field of Classification Search
CPC ..... A43B 13/183
USPC ..... 36/27
See application file for complete search history.

(56) References Cited

U.S. PATENT DOCUMENTS 4,910,884 A * 3/1990 Lindh ..... A43B 13/18 36/27
5,279,051 A * 1/1994 Whatley ..... A43B 13/181 36/114
7,314,125 B2 * 1/2008 Smaldone ..... A43B 21/26 267/143
7,779,558 B2 * 8/2010 Nishiwaki ..... A43B 13/189 36/27

(Continued)

FOREIGN PATENT DOCUMENTS

CN 200966377 Y 10/2007
CN 202774438 U 3/2013

(Continued)

OTHER PUBLICATIONS

International Search Report of PCT International Application No. PCT/EP2021/060284 dated Jul. 6, 2021.

*Primary Examiner* — Ted Kavanaugh
(74) *Attorney, Agent, or Firm* — RAPHAEL BELLUM PLLC

(57) ABSTRACT

The disclosure describes a spring device for a shoe for arrangement between an insole and an outsole. The spring device comprises a lower outsole portion and an upper insole portion, wherein the lower outsole portion and the upper insole portion are connected to each other via a curvature. At least one section of the curvature has a continuously varying radius of curvature, which increase towards the outsole portion. Both portions may be substantially parallel with respect to each other in a resting state.

17 Claims, 7 Drawing Sheets

(56) References Cited

U.S. PATENT DOCUMENTS

| | | | | |
|---|---|---|---|---|
| 2002/0133977 | A1* | 9/2002 | Pan | A43B 21/26 36/35 R |
| 2003/0069807 | A1 | 4/2003 | Lyden | |
| 2004/0068891 | A1 | 4/2004 | Wang | |
| 2005/0268488 | A1* | 12/2005 | Hann | A43B 13/16 36/27 |
| 2012/0285040 | A1 | 11/2012 | Sievers | |
| 2013/0192090 | A1 | 8/2013 | Smith, IV | |
| 2014/0230280 | A1* | 8/2014 | Heard | A43B 7/38 36/102 |
| 2015/0040432 | A1* | 2/2015 | Berend | A43B 13/20 36/102 |
| 2015/0089834 | A1 | 4/2015 | Baum | |

FOREIGN PATENT DOCUMENTS

| | | | |
|---|---|---|---|
| DE | 102009050783 | A1 | 5/2011 |
| DE | 102011007996 | A1 | 7/2012 |
| EP | 3457882 | A1 | 3/2019 |
| WO | 20150138815 | A2 | 9/2015 |
| WO | 2017028712 | A1 | 2/2017 |
| WO | 2017/158408 | A1 | 9/2017 |

* cited by examiner

DAMPING ELEMENT FOR A SHOE

The present description relates to damping and spring elements for shoes and to methods for adapting such elements. The present description relates in particular to damping and spring elements for running shoes and to running shoes with such damping elements and to methods for adapting damping elements for running.

Damping plays an important role for shoes in general, and in particular for running shoes. On one side, the impact energy is absorbed and damped during striking, in the so called landing phase in order to protect the body of the athlete, in particular the joints and ligaments and the passive musculoskeletal system from damages and immoderate stress. The damping elements shall, on the other side, return the energy that was collect during the strike during push-off, such that as little energy as possible is absorbed in order to make the resistance for running as low as possible.

Damping elements often have a heel damper, that takes-up the impact energy during the strike, in particular during a so called heel strike running. Besides this, damping elements comprise a forefoot damper, that releases the energy during push-off and that takes up energy on the forefoot during striking in sportive running, in particular in midfoot running or forefoot running.

There is a need for improved damping elements for shoes.

SUMMARY

The disclosure relates to a spring element for a shoe, to a damping element with at least one spring element for a shoe and a shoe with a corresponding spring element according one of the independent claims.

The disclosure describes a spring device for a shoe for arrangement between an insole and an outsole. The spring device comprises an outsole portion and an insole portion, wherein the outsole portion and the insole portion are connected to each other via a curvature. At least one section of the curvature has a continuously varying radius of curvature, which increase towards the outsole portion according to a segment of an elliptic and/or a parabolic curve.

The description also relates to a damping device with such spring devices and to a shoe, which comprises such damping elements. The present description relates to a damping device for a shoe for arrangement between a shaft portion and an outsole. The damping device comprises a heel spring and a forefoot spring, which are connected to each other by an insole. At least one of the heel spring and the forefoot spring comprises an outsole portion and an insole portion, wherein the outsole portion and the insole portion are connected via a curvature. At least one section of the curvature has a continuously varying radius of curvature, which increase toward the outsole portion according to a segment of an elliptic and/or a parabolic curve.

The description also relates to a shoe which comprises an insole, an elastic outsole and at least one damping element arranged between the insole and the outsole. The at least one damping element comprises a spring device that comprises an outsole portion and an insole portion, wherein the outsole portion and the insole portion are connected to each other via a curvature. At least one section of the curvature has a continuously varying radius of curvature, which increase toward the outsole portion according to a segment of an elliptic and/or a parabolic curve.

The disclosure further relates to a method for arranging spring elements and damping device for shoes.

Further embodiment which show advantageous aspects are given in the dependent claims.

BRIEF DESCRIPTION OF THE FIGURES

The inventions may be better understood while reading the following description that is given in relation to the figures, wherein.

DETAILED DESCRIPTION

Figure 1A:
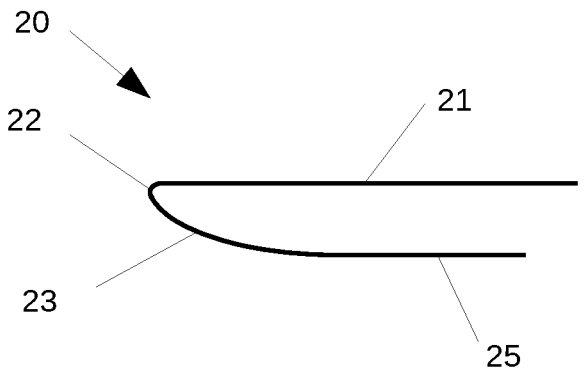
FIGS. 1A, 1B, 1C, and 1D show an example of a spring element in various states.

Examples are given in the following detailed description of the invention that show aspects and embodiments of the invention by way examples that are not limiting. It is not necessary for practicing the invention to implement all features described in relation to one or more examples. A person skilled in the art will rather acknowledge that some features may be left out of replaced by others without deviating from the invention.

The present disclosure describes in one aspect a shoe with a damping device. The shoe comprises a shaft and an insole, wherein the damping device is arranged between the insole and an outsole. The following description mainly refers to running shoes, which are a main application. The damping device, however, can be equally used with other sport shoes or other types of shoes, where special damping and energy transmission is relevant.

The damping device can comprise one or two spring elements. In particular, a forefoot spring and/or a heel or hindfoot spring can be provided.

The spring element can be a forefoot spring, that is arranged underneath the ball of a user. The forefoot spring comprises an insole portion and an outsole portion. The insole portion is fixedly connected to or integrated into the insole below the ball. The insole portion is rigid and takes up the load acting on the ball or returns the energy to the ball.

The outsole portion is connected to the outsole. The outsole can be a rubber sole or can be made from another usual sole material. The outsole comprises a plurality of portions, mostly at least one forefoot portion and a heel portion. The outsole can be a single piece or can comprise a plurality of elements. For example, the outsole or some portions of the outsole can be made from a plurality of layers or material stacks. The forefoot portion of the outsole can be attached directly or via one or more interlayers to the outsole portion of the forefoot spring, for example with adhesives.

The outsole portion and the insole portion can be arranged substantially in parallel in a resting state. The outsole portion and the insole portion may also be substantially parallel with respect to each other in a static load condition, while the outsole portion and the insole portion are opened to an angle in an unloaded condition. The angle can be up to 45°. The forefoot spring allows an elastic compression when the load on the forefoot exceeds a pre-defined value. The distance between the insole portion and the outsole portion is lowered and the forefoot spring is deflected such that the forefoot spring has the tendency to move back to the resting state. The outsole portion and the insole portion are connected to each other by a curved portion. The forefoot spring can have a shape similar to a U-type shape in a cross section. The forefoot spring can in particular have an asymmetric U-shape. The radius of curvature can be lower at the insole portion than at the outsole portion. In other words, the radius of curvature at the upper area close to the insole can be smaller than in the lower area facing towards the outsole. The radius of the curved portion can increase from the insole portion to the outsole portion. The radius of the curvature portion can constantly and/or continuously increase from the insole portion to the outsole portion. In the area of the increasing radius, a roll portion of the forefoot spring results. It has been found to be advantageous for running, if this roll portion corresponds to an oval curve in a cross section. This oval curve can be an elliptic curve or a parabolic curve.

With the roll portion being formed according to an oval curve, the athlete can optimally roll his foot forward over his/her ball. The curvature of the forefoot spring is arranged towards the front towards the tip of the shoe and is arranged anterior to the ball of the athlete. The forefoot spring is arranged such that the insole portion is located below the ball and the outsole portion is below but also behind the balls of the athlete. The outsole portion and the insole portion are arranged towards the heel with respect to the curvature.

The radius of curvature can be constant in a first segment at the insole portion, such that a circular curvature results. The constant curvature can comprise a segment of 70 to 120°, in particular 80 to 110°.

In addition or as an alternative, the stiffness of the material can be constant in an area at the insole portion. The material can be enforced in this area and/or can be made from a stiffer material. In addition or as an alternative, the rigidity of the material may continuously decrease towards the outsole portion.

The description also relates to a method for arranging a forefoot spring at a shoe. The forefoot spring is positioned at the shoe, such that the transition between the outsole portion and the roll portion is in an area below the ball of a user. This means, the roll area is positioned in front of the ball, thus at least partially below the toes of the user. The positioning can be adapted to the individual anatomy of the user and can, for example, be different at the right and left shoe, if required.

The shape and arrangement of the forefoot spring described above relates to the resting state. The resting state can be the state completely without load, where no load is applied to the spring or to the shoe. The resting state can also be a state, where the athlete is standing still in the shoe. The shape and arrangement of the forefoot spring can change during compression. When the forefoot spring is compressed, the radius of curvature may change, for example. The change of the radius of curvature can be different in different positions. The radius of curvature can change in particular in the roll portion. The change in radius of curvature during compression may also occur in the area of highest curvature.

The forefoot spring can have a constant spring constant. The spring constant can also be a variable spring constant that varies depending in the spring deflection. The spring constant can be adapted or designed for an athlete by way of material parameters in the curvature portion and/or in the roll portion of the forefoot spring. The material parameters comprise at least one of material thickness, cross section of the material, width of the material, composition of the material, arrangement of material layers and positioning of fibers within the material. The material can be a fiber composite material. The material can comprise carbon fibers. For example, the spring material can comprise a mixture of carbon fibers and at least one of polyamide or polypropylene. The material parameters may be varied gradually or continuously along to roll portion and/or the curvature portion.

The forefoot spring can, for example during forefoot running (forefoot strike), where the athlete only runs on the forefoot, take-up the entire impact energy and release it again during push-off. With midfoot running or with heel running, the energy is taken-up at least partially in the heel area and is then transferred to the forefoot spring, whereby the forefoot spring elastically compresses and releases its energy during push-off.

Depending on the use case, only a forefoot spring can be provided, for example for fast runners or for athletes that focus on forefoot running. A heel spring can then be omitted for weight reduction, or the heel spring is designed in a simple way. It is also possible to provide a forefoot spring according to the present description and a conventional design or a conventional damper in the heel area.

For heel running or midfoot running it is advantageous if also a heel spring is provided.

The heel spring can be similar to the forefoot spring and can comprise an insole portion, an outsole portion, a curvature portion and a roll portion. In contrast to the forefoot spring, the heel spring is arranged such that the curvature is oriented towards the end of the shoe and the insole portion and the outsole portion extend frontwards towards the shoe center. The insole portion of the heel spring is arranged below the heel and takes-up the force acting on the heel. The outsole portion is arranged further to the front in an anterior area of the hindfoot towards the midfoot. The heel spring can be adapted to the anatomy of the athlete and can be positioned at the shoe, such that the roll portion is arranged in a posterior area of the heel and the outsole portion is arranged in an anterior area of the heel. The material thickness and the spring constant can be adapted to the requirements at the heel, and can be chosen, for example, somewhat stiffer or softener than the forefoot spring. The distances between outsole portion and insole portion can larger compared to the forefoot spring, achieving a larger spring deflection and a shoe heel level.

The description also relates to a method for arranging a heel spring at a shoe. The heel spring is positioned at a shoe such that the transition from the outsole portion to the roll portion is arranged in the area below the heel of a user. This means, that the roll portion if positioned in an area behind the posterior heel of the user. The positioning can be adapted to the individual anatomy of the user and can be different in the left shoe and in the right shoe, if required.

Only a heel spring according to the present disclosure may be used, and a different construction may be used in the forefoot area. The forefoot spring and the heel spring can be arranged together, or independently from each other in a shoe.

The heel spring and the forefoot spring can be connected advantageously by a midfoot portion to their respective insole portions and can form the damping device. The midfoot portion is more flexible than the insole portion of the heel spring and the insole portion of the forefoot spring. The midfoot portion allows in particular a rotation and a torsion of the insole portions with respect to each other. The midfoot portion also allows for a mechanical connection of the forefoot spring and the heel spring. Advantageously, the midfoot portion can transmit a force from the heel spring to the forefoot spring and avoid loss of energy. The midfoot portion, the heel spring and the forefoot spring form an example of a damping device. The insole portions can be attached to the midfoot portion, for example by adhesives or by welding. The damping device comprising the midfoot portion, the heel spring and the forefoot spring can be formed in one single piece. The damping device of the example above can then be attached to a separate insole, which may be a conventional insole.

In an alternative example, the insole provides the midfoot portion. In this example, the insole portion of the heel spring and the insole portion of the forefoot spring are directly attached to the insole. A separate midfoot portion below the insole can be omitted in this example. The insole can have a substantially planar base in the resting state. Ergonomically advantageous, the insole has an S-curved shape to provide a difference in height between the forefoot spring and the heel spring and to provide a heel for the shoe. Further, supports in the lateral area and/or in the heel area can be provided. The insole can comprise carbon fibers and can be a carbon-polyamide or a carbon-polypropylene composite. It can be advantageous, if the insole is made from the same material as the spring elements. The material can be weldable under pressure and/or heat, for example. The spring elements can be thereby welded to the insole by a material bond. As an alternative, the insole can be attached to the spring elements by adhesives or in another manner, which, however may increase manufacturing efforts. A reversible attachment is also possible. The insole allows in any case for a torsion, twist or rotations of the forefoot spring with respect to the heel spring. The insole can also enable the transmission of forces from the heel spring to the forefoot spring.

The insole including the midfoot portion may further be directly integrated or included into the shaft. The sole portion of the shaft can be made from different fibers or different materials and can have a different stability. A firmly bonded welding of the insole with the shaft can be avoided. This provides an advantage of lower manufacturing efforts and there is no need for a reversibly removable attachment of the insole to the shaft of the shoe. The insole integrated into the shaft enables the torsion of the forefoot spring with respect to the heel spring and the rotation (bending) of the insole posterior to the forefoot spring.

The insole can have sections that are differently configured. An insole heel section and an insole forefoot section can be substantially rigid to provide a good support underneath the heel and underneath the forefoot/ball, respectively, and to provide a good transmission of forces to the corresponding spring elements. The midfoot section in between the insole forefoot section and the insole heel section can be configured to be elastic and can allow for a torsion of the insole forefoot section with respect to the insole heel section. The midfoot portion comprises an elastic restoring force, that restores a rest state from a possible torsion state without application of an exterior force. The midfoot portion additionally comprises a predefined point of rotation where the insole is elastically bendable, such that an angle between the insole forefoot section and the insole heel section is made possible. This is also achieved by and elastic spring motion, wherein the insole is configured to return to the rest state, when no external force is applied. The spring constant of the rotational movement and/or of the spring constant of the torsion can be tuned to the individual needs of the athlete. The spring constant may be linear or can vary as a function of the corresponding spring deflection. The elasticity of an insole section relates to the torsion and the rotation around axes that run in the plane of the insole. The elasticity does not or only to a small extend relate to the ability of the insole section to be stretched along the longitudinal or along the transverse axis, such that the distance between the forefoot spring and the heel spring along the midfoot portion remains substantially constant.

The insole can have a substantial uniform flexibility or elasticity. By connecting the insole heel section to the insole heel portion of the heel spring, the insole heel section may be reinforced, such that the desired strength is obtained. As an alternative or in addition, the desired strength and rigidity of the insole section can be obtained by attaching the insole forefoot section to the insole portion of the forefoot spring.

The insole is either firmly bonded to the shaft, or directly integrated into the shaft. The insole allows for torsion of a forefoot spring with respect to a heel spring and the rotation (bending) of the insole posterior to the forefoot spring. The characteristics of the insole can be individually configured to the needs of the athlete by specific material parameters. Material parameter comprise at least one of material thickness, cross section of the insole, width of the insole, material composition, arrangement of material layers and positioning of fibers within the material. The material may comprise carbon fibers. For example, the material of the springs may be a mixture of carbon fibers and at least one of polyamide and polypropylene.

The heel spring 20 and the forefoot spring 30 can additionally be connect by an ductile module 50 which connects the outsole portion 25 of the heel spring to the outsole portion 35 of the forefoot spring. The elastic module may enable, with a torsion or rotation or bending of the insole, a corresponding movement of the spring elements and may, in the same time, provide a restoring force towards the resting state. The ductile module 50 may be and elastically ductile strap or may be assembled from several elastic ductile elements and may provide a restoring force when stretched similar to a rubber expander.

The ductile module 50 may be directly integrated into the outsole.

Examples of the invention will now be described in more detail with respect to the attached figures. Elements relevant to the disclosure are described in the figures. Other elements and parts that are common with shoes, such as the shaft, the outsole, an additional inner sole or a lining are not shown and can be easily added by a person skilled in the art.

FIG. 1A shows in an example of a heel spring 20, a possible design of a spring element that can be used with the present disclosure. A forefoot spring 30 can be designed similarly. The heel spring is shown in the rest state in FIG. 1A, this means without any load of an athlete or without an athlete standing still.

Figure 1B:
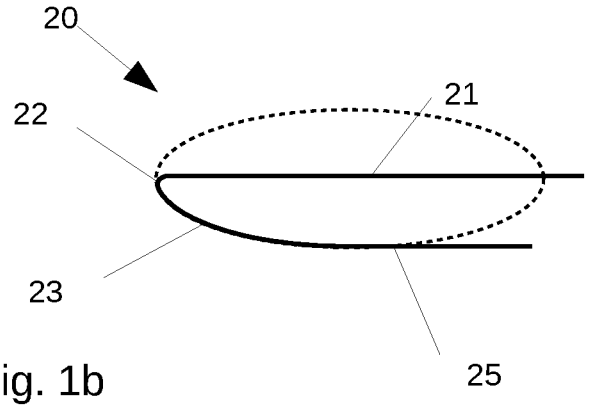

The heel spring 20 comprises an insole portion 21 and an outsole portion 25. The insole portion 21 is in use arranged underneath the heel and is attached to or integrated into the insole. The insole portion 21 is a substantially rigid plate and takes-up forces applied to the heel. The insole portion is rigid in so far, as it does not deform under load. The rigid plate ca be flat or planar or can have slightly concave shape in order to hold the heel of the user. The outsole portion 25 is attached to the outsole. The outsole portion 25 and the insole portion 21 are substantially parallel in the rest state. A space remains between the outsole portion 25 and the insole portion 21, which acts as deflection space during deflection. The distance between the outsole portion 25 and the insole portion 21 of the heel spring can be about 7 to 15 mm in the rest state with static load by the weight of an athlete. However, large deflection pitches of, for example up to 40 mm can be provided, if the heel is higher. The outsole portion 25 and the insole portion are connected to each other by a turn or bend, such that the heel spring may be similar, in a cross section, to an asymmetric lying U-shape. If the spring elements is off loaded, the heel spring may open further and an angle of up to 45° may result between the outsole portion 25 and the insole portion 21. The turn has a first curvature 22 with a substantially constant radius of curvature. The constant radius of the first curvature may be in one example up to 5 mm. In another example it may be up to 20 mm. The first curvature corresponds to a segment of a circular arc in a cross section. As an example, the first curvature may comprise a segment of about 90°, as shown in FIGS. 1A, 1B, 1C, and 1D. The curvature may in other examples comprise a segment of less or substantially more than 90°, depending on the design of the spring. A segment of clearly more than 100° is shown in FIG. 2C. The first curvature 22 is connected to the outsole portion 25 via the roll portion 23. The roll portion 23 comprises a curvature with a larger radius than the first curvature 22. In particular, the radius of curvature changes along the roll portion 23. The radius of curvature of the roll portion is at the connection to the first curvature lowest and increases towards the outsole portion 25. It may increase continuously, as shown in the example. The roll portion may have a curvature corresponding to an oval shape in a cross section, for example a segment of an ellipse. This basic shape is shown in FIG. 1B for illustrative purposes. The ellipse segment is arranged in the example of FIG. 1B such that the main axis of the ellipse is substantially horizontal and/or parallel to the sole portion in the rest state. In another example, an ellipse segment of an inclined ellipse (FIG. 2C) can be selected, for example with an ellipse main axis in an angle of 1 to 30 degrees with respect to the outsole and/or the outsole portion. A particular good rolling will be obtained with an angle in a range between 5 to 20 degrees.

Figure 1C:
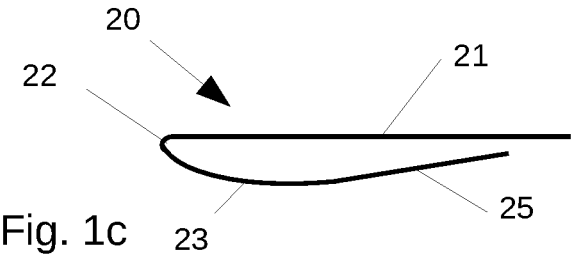
Figure 1D:
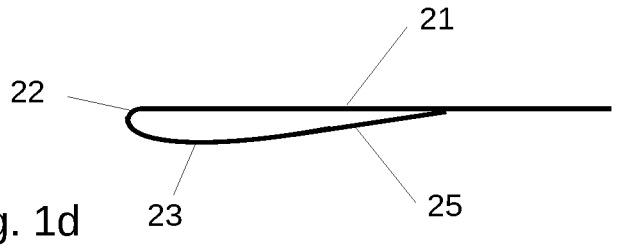

FIGS. 1C and 1D show the heel spring 20 of FIGS. 1A and 1B in different compressed or deflected states. Deflection mainly occurs during running with the shoe, for example when a higher load compared to the rest state occurs during strike. It can be seen, that neither the insole portion 21 nor the outsole portion 25 a substantially deflected. The first curvature 22 also remains almost unchanged, while the main elastic deflection occurs within the roll portion 23. The use of a curvature gradient that corresponds to a segment of an ellipse or of a parabolic curve, results in a harmonic, natural rolling with optimized force transfer. The first curvature 22 may be substantially more rigid and firm than the roll portion 23. Thereby, the mechanically heavily loaded first curvature portion of the heel spring becomes more stable and long-lasting. Depending on the choice of material, a portion of the deflection movement may be allowed in the first curvature 22.

Figure 2A:
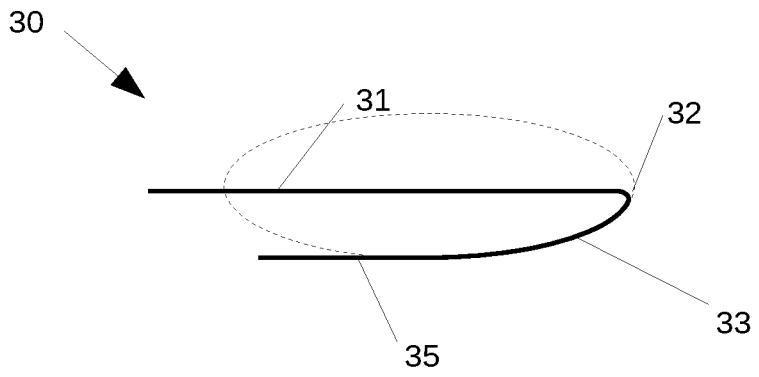
FIGS. 2A, 2B, and 2C show an example of a spring element that may be used as forefoot spring.

FIG. 2A shows a forefoot spring 30, that substantially corresponds to the heel spring 20. To avoid repetition, only the main differences are described in the following. If not stated otherwise, the forefoot spring corresponds in arrangement and function to the heel spring. The forefoot spring 30 provides a smaller distance between the insole portion 31 and the outsole portion 35. The distance may be in the range of 5 to 10 mm, typically in the range between 6 and 8 mm. Up to 40 mm are possible with thicker soles. The different heights can provide a heel offset to the shoe. Due to the smaller distance, the first curvature 32 and the roll portion 33 of the forefoot spring may have a smaller radius than shown for the heel spring in FIGS. 1A, 1B, 1C, and 1D. The roll portion of the forefoot spring may be somewhat shorter to compensate for the difference in height. The roll portion corresponds here also to an oval curve, in the example shown a segment of an ellipse. The ellipse has, in the example of FIG. 2A, a horizontal main axis, which is oriented parallel to the outsole portion 35.

Figure 2B:
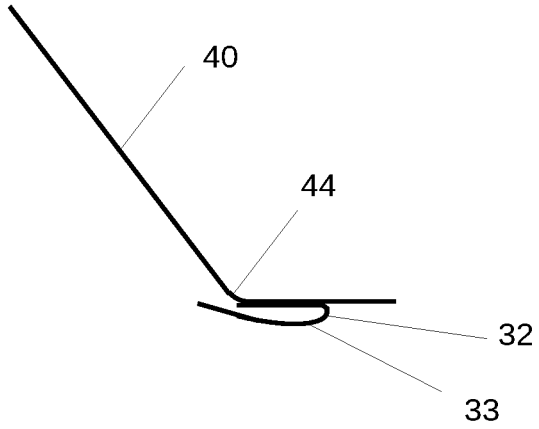
Figure 2C:
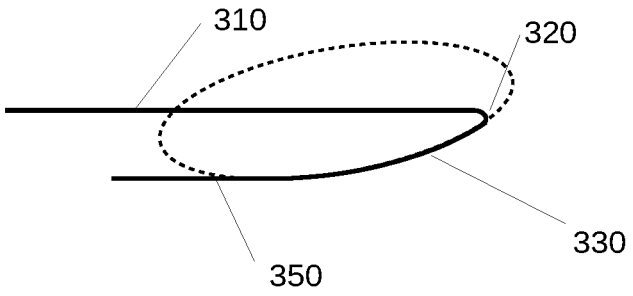

FIG. 2B shows the forefoot spring of FIG. 2A during push-off. The forefoot spring 30 is here compressed. The illustration shows further an insole 40, to which the insole portion 31 of the forefoot spring is attached. The insole 40 may bend-in during push-off and may provide a turn at a pre-defined position 44 posterior to the ball position.

FIG. 2C shows an alternative example to FIG. 2A, wherein the roll portion 330 corresponds in a cross section to a segment of an ellipse, wherein the ellipse has a main axis that is arranged in an offset angle with respect to the horizontal or with respect to the outsole portion. In the example shown, the offset angle is 10°. The offset angle, however, can be adjusted depending on the desired parameters. The length of the roll portion 330 and the positioning of the first curvature 320 and the radius of the first curvature may also be adjusted to the desired parameters. At least one of deflection distance, spring stiffness, variation of the spring constant and length of the roll path along the roll portion 330 may be adjusted. The adaption can be pre-defined of can be individually adapted to the athlete and her/his anatomy.

The variations and adaptions of the spring described in relation to the forefoot spring in with regard to FIG. 2C, may be applied equally or correspondingly to the heel spring.

Figure 3A:
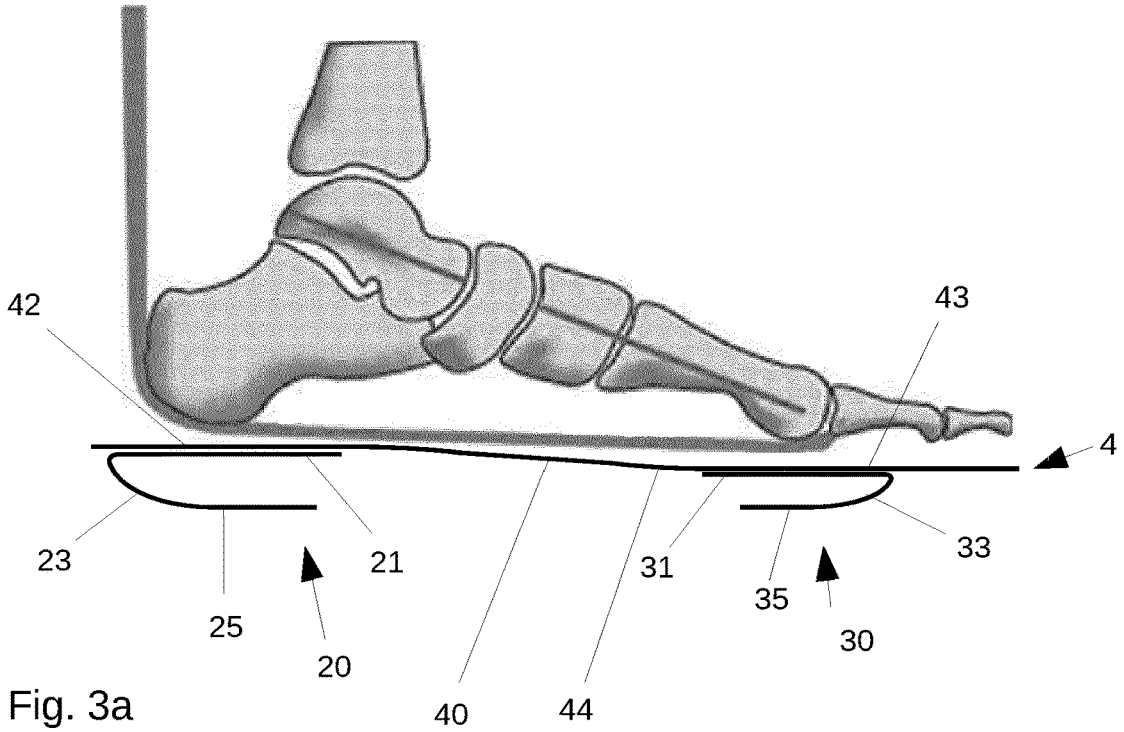
FIGS. 3A and 3B show an exemplary arrangement of a damping device below a foot.

FIG. 3A shows a damping device according to the present disclosure and how the damping device may be arranged in use. The damping device comprises a heel spring 20 as described with respect to FIGS. 1A, 1B, 1C, and 1D, and a forefoot spring 30 as described with respect to FIG. 2A. The insole portion 21 of the heel spring and the insole portion 31 of the forefoot spring are connected to each other with the midfoot portion 40, implemented here within the insole 4.

The insole 4 comprises further differently configured portions in addition to the midfoot portion, in particular an insole heel portion 42 and an insole forefoot portion 43. The insole heel portion 42 and the insole forefoot portion 43 have a high stiffness to provide a good support underneath the heel and the ball and to allow for a good force transmission to the corresponding spring elements. The increased strength and stiffness of the insole 4 in the insole heel portion 42 is, in the example shown, obtained by the attachment to the insole portion 21 of the heel spring 20. This is achieved by doubling the material and by the stiffness of the heel portion 21 of the heel spring. The strength of the insole forefoot portion 43 is equally enforced by the forefoot portion 31 of the forefoot spring 30. Each of the insole portions is welded to the insole. As an alternative, the insole can be glued or be attached otherwise. In a further example, the insole may be directly integrated into the shaft of the shoe.

The insole forefoot portion 43 and the insole heel portion 42 are connected via the midfoot portion 40. The midfoot portion 40 can equalize the difference in height between the forefoot spring and the heel spring. The midfoot portion 40 is elastic, to enable torsion of the insole forefoot portion with respect to the insole heel portion. The midfoot portion 40 provides an elastic restoring force that moves a possible torsion back to the resting state without application of external forces. The midfoot portion additionally provides a pre-defined bending point 44, at which the insole may be elastically bend, such that an angle between the insole forefoot portion and the insole heel portion becomes possible. This also occurs with an elastic spring motion, such that the insole is configured to return to the rest state, when no external force is applied. The spring constant of the rotational movement and/or the spring constant of the torsion can be adjusted to the individual needs of the athlete. The spring constant may be linear or may vary depending on the corresponding deflection.

Figure 3B:
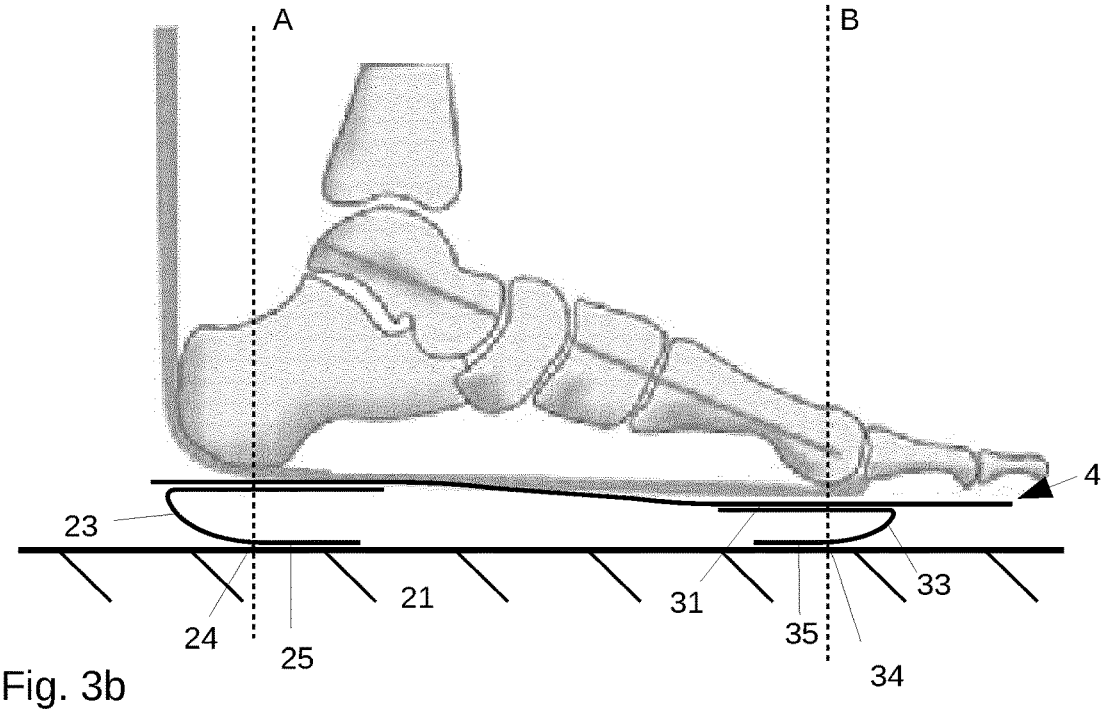

FIG. 3B shows, how the heel spring 20 may be arranged underneath the heel of an athlete and how the forefoot spring 30 may be arranged underneath the ball. The heel spring 20 may be arranged such that the transition point 24 between the outsole portion 25 and the roll portion 23 of the heel spring 20 is positioned below the heel point of the standing athlete, as indicated by line A in FIG. 3B.

The forefoot spring 30 is positioned underneath the ball of the still-standing athlete as indicated by line B in FIG. 3B, such that the transition point 34 between the outsole portion 35 and the roll portion 33 is positioned underneath the metatarsophalangeal ball bone. This provides an optimized damping, good rolling and optimizes return of energy during push-off.

Figure 4:
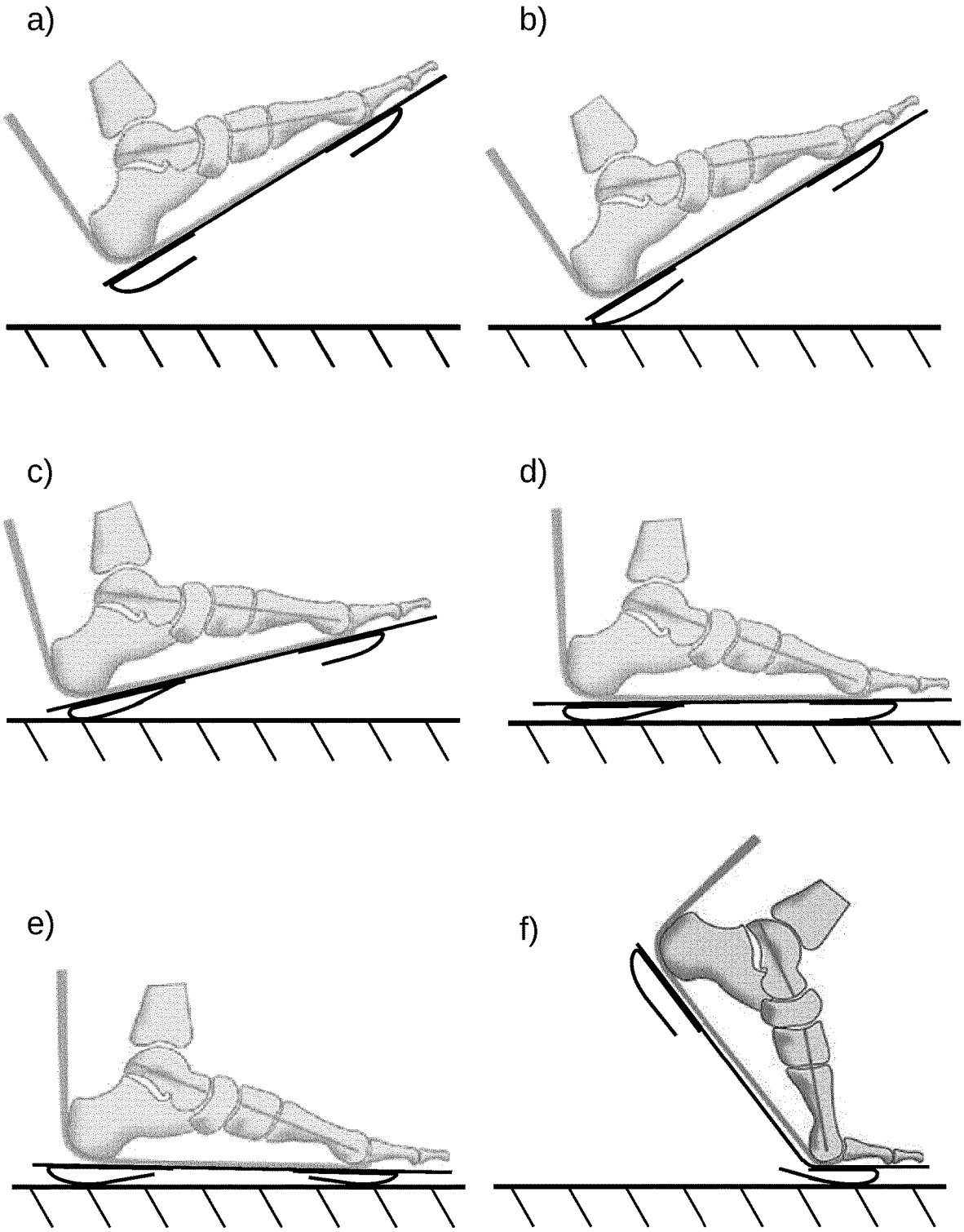
FIG. 4 shows the damping device of FIGS. 3A and 3B during heel strike running.

FIG. 4 exemplarily and schematically show different stages of a step in heel running. (a) shows the damping device on a foot, before the contact with the ground. The heel spring 20 and the forefoot spring 30 are relaxed. During heel running, the athlete first touches the ground with the end of his heel, as shown in (b). Thereby, the upper area of the roll portion 23 is the first one to receive a force. The heel spring is compressed by this and the impact is damped right from the beginning. The landing athlete rolls over the roll portion 23, whereby the heel spring 20 deflects further and absorbs the impact energy, as shown in (c). The heel spring is adapted to the athlete, such that the impact energy is widely taken-up in the heel spring.

As the athlete moves on, a part of the load is transferred to the forefoot, the forefoot spring deflects to some extent, while the heel spring emits some energy and partially bounces back, as shown in (d) and (e). During further movement, the heel lifts off, the heel spring 20 fully restores and the insole bends upwards posterior to the ball, as shown in (f). The bending of the insole also stores energy that will be returned during push-off together with the energy stored in the forefoot spring 30 and supports the push-off.

The impact energy is transferred as good as possible from the heel spring to the forefoot spring through the bending of the insole in this sequence and supports the push-off, such that the athlete experiences as little resistance as possible.

Figure 5A:
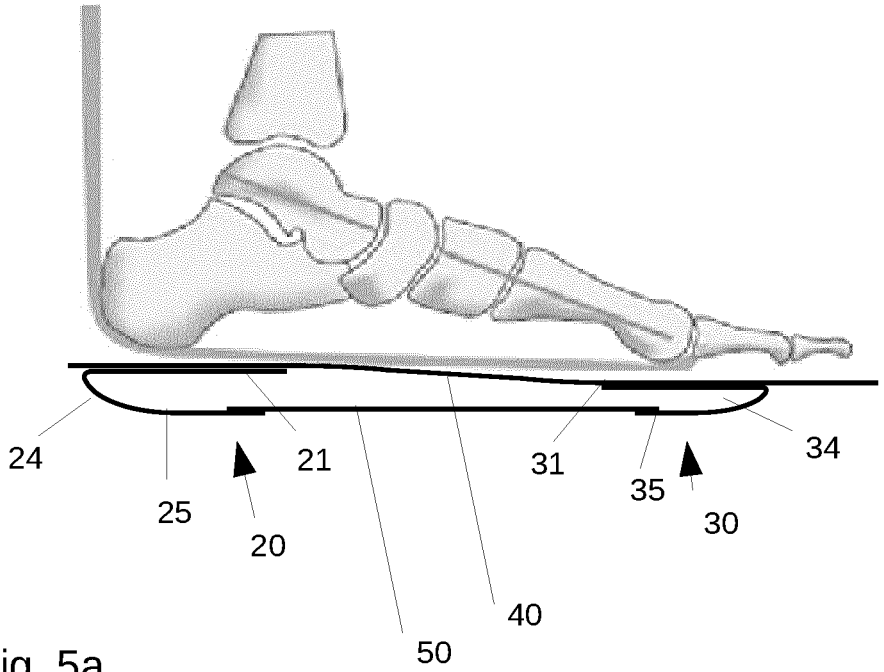
FIGS. 5A and 5B show a damping device with an elastic sole band.
Figure 5B:
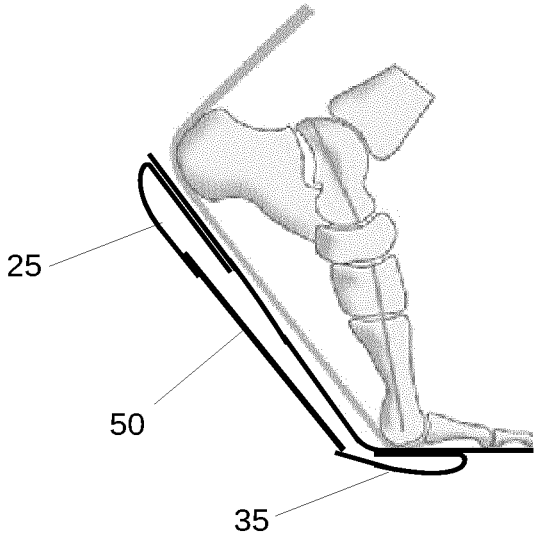

FIGS. 5A and 5B show a further example of a damping device according to the present disclosure. The damping device corresponds to a damping device with spring elements of the preceding description, wherein an additional elastic ribbon 50 is arranged between the sole portion 25 of the heel spring and the sole portion 35 of the forefoot spring. The ribbon 50 is substantially relaxed or slightly prestressed in the resting state. When the insole 40 is bent, the distance between the sole portion 25 of the heel spring and the sole portion 35 of the forefoot spring increase and the ribbon 50 is elastically stretched whereby additional energy can be taken-up when bending the insole. This energy is returned back during push-off and de-loading of the planum (ball), thereby additionally supporting the push-off.

Figure 6A:
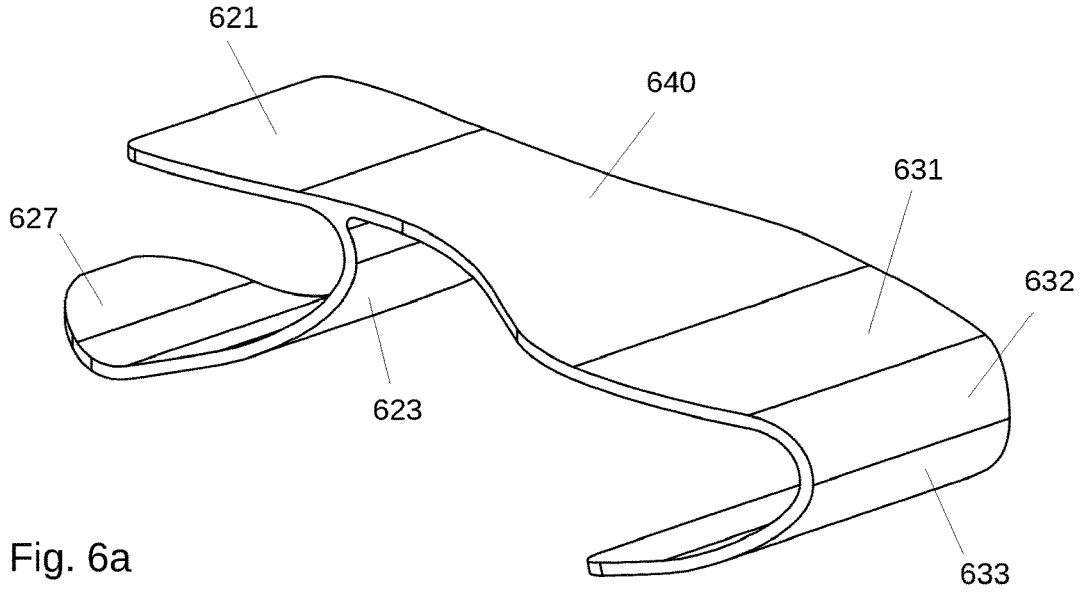
FIGS. 6A, 6B, and 6C show a further example of a damping device in various views.
Figure 6B:
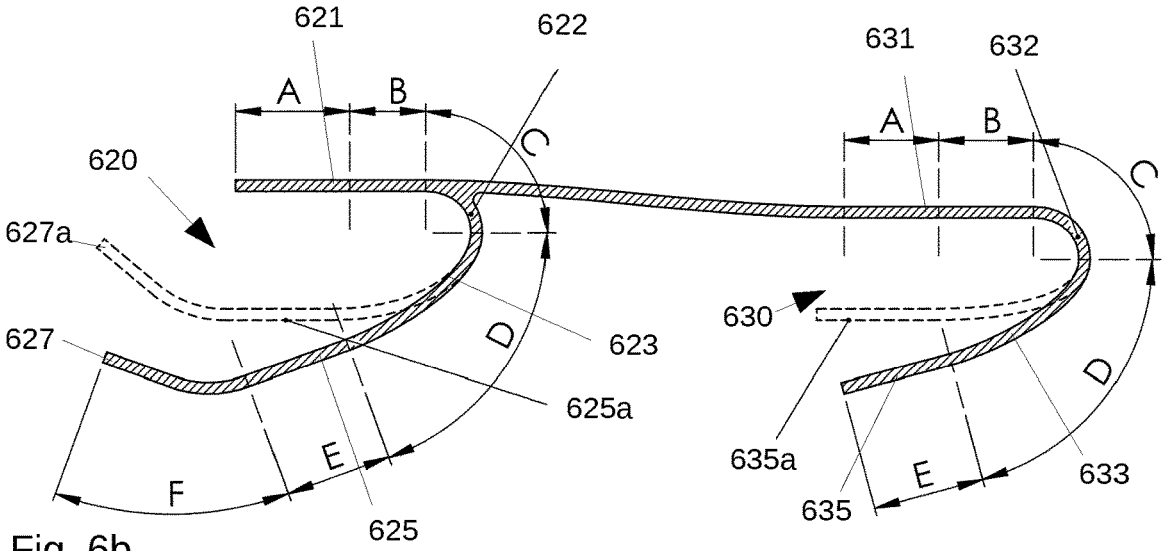
Figure 6C:
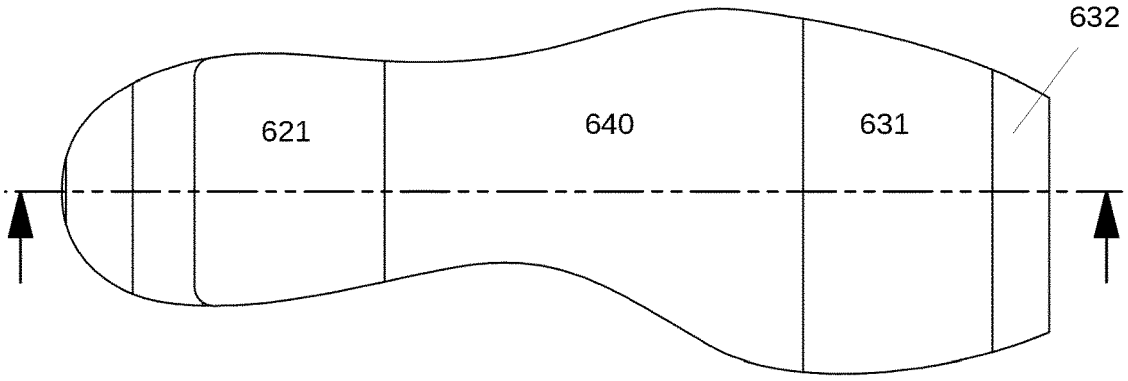

FIGS. 6A, 6B, and 6C show a further example of a damping device with an altered arrangement of the heel spring 620. FIG. 6A show a diagonal view and FIG. 6B a cross section through the damping device along an axis shown in FIG. 6*c*. In FIGS. 6A, 6B, and 6C, the heel spring 620 is arranged with the spring being open towards the back. The curvature is arranged toward the tip as is with the forefoot spring 630.

The forefoot spring 630 is a variation of the forefoot spring 30 described above. Like the forefoot spring 30 described with respect to FIGS. 2A and 2B, forefoot spring 630 comprises an insole portion 631 and adjoining first a first curvature segment 632 directed towards the shoe tip and subsequently a second curvature segment 632 and the roll portion 633. An outsole portion 635 adjoins the roll portion 633. In the following, only the main differences are addressed and, unless described otherwise, you may refer to the above mentioned.

The insole portion 631 substantially is a planar and rigid area. The width of the insole portion 631 becomes smaller towards the shoe tip. If follows the shape of the insole, to which the shape can be adapted. The insole portion is divided in two substantially equally long portions A and B along the longitudinal axis. The interface between the two portions defines the best position of the metatarsophalangeal. This allows for a good transmission of forces from the ball/forefoot of the athlete to the forefoot spring 630 and in particular to the first curvature segment 632.

The first curvature segment 63 directly adjoins to the insole portion 631 and can be made from the same material, for example from a composite material. As an example, carbon and/or glass fiber filaments can be lanced through several or all portions. This enables a transmission of forces. The first curvature segment 632 has a substantially constant curvature with constant radius in a cross section, as can be seen in the cross sections of FIG. 6B. A segment of a circular arc results in the cross section. The constant radius can be maximum 5 mm in a first example. It can be up to 20 mm depending on the thickness of the sole. The first curvature segment comprises about 90° in the example shown. It can also comprise more or less. The first curvature segment can comprise 100° of 120° to make the forefoot harder and/or less thick. If the forefoot spring 620 receives a load and thereby is compressed, the first curvature segment 632 will be elastically deflected. The entire energy is transmitted across this first curvature segment. The first curvature segment may be reinforced by additional layers of carbon fibers.

The first curvature segment 632 merges into the second curvature segment 633. In contrast to the first curvature segment 632, the radius of curvature of the second curvature segment 633 is not constant but constantly increases from the constant radius of the first curvature segment towards the outsole portion 635. The continuous increase corresponds to a segment of an elliptic or of parabolic curve in a cross section. The inventor found that this elliptic or parabolic transition improves elastic deformation, which is excellent for elastic deflection, rolling and force transmission. The elliptic or parabolic shape substantially improves natural rolling during running. The second curvature segment is therefore also termed roll portion. The inventor found that the proposed geometry enables natural rolling without having to change the stiffness of the material or other material parameters. This reduces manufacturing cost. The material of the second curvature can, however, be made substantially more elastic than the material of the first curvature segment to further support the rolling and spring deflection and to adapt more precisely to needs of the athlete.

The roll portion 633 adjoins to the outsole portion 635. The outsole portion can be more rigid comparted to the roll portion 633. The outsole portion 635 provides contact and force transmission to the ground and to the outsole. FIG. 6B shows the forefoot spring in half compressed, deflected or loaded position in dotted lines. This approximately corresponds to the shape, where the spring is under static load of a user, for example while standing still. The spring will then be further compressed during push-off.

In a further example that is not illustrated, the outsole portion and, in yet a further example, additionally the roll portion may be cut into two parts along the longitudinal axis. Two distal ends of the outsole portion result, an inner outsole portion underneath the inner foot and an outer outsole portion underneath the outer foot. By adapting the width of the inner and outer outsole portions and, optionally the inner and outer roll portions, the rigidity and stiffness can be easily adjusted. In addition, the stiffness at the inner side of the foot my differ from the stiffness at the outer foot side, if, for example, desired for orthopedic reasons.

The forefoot spring 630 of FIGS. 6A, 6B, and 6C is connected to the heel spring 620 via a midfoot portion 640. The insole portion 631 of the forefoot spring 630 may be attached to the insole of a shoe together with the midfoot portion 640 and the insole portion 621 of the heel spring 620. The insole portion 631 of the forefoot spring 630 may also be formed as a part of the insole together with the midsole portion 640 and the insole portion of the 621 of the heel spring 620. In both cases, the width may be adapted to the shape of the insole, as shown in FIG. 6C.

The heel spring 620 is designed similar to the forefoot spring 630 and also comprises an insole portion 621, a first curvature segment 622, a second curvature segment of roll portion 623 and an outsole portion 625. Unless described differently, the heel spring 630 corresponds in its design and function to the forefoot spring 630 and is not repeated here. Different to the forefoot spring 630, the heel spring 620 may comprise and additional heel end 627, that is arranged posterior to the outsole portion 625 and that extends towards the back, lifting the end of the sole upward towards the back. The heel end 627 first touches the ground during usual heel running and starts deflecting the heel spring. The deflection and damping during landing on the heel become more harmonic, in particular if the angle of the sole is large, which will depend on the running style. The dotted lines show the heel spring with the outsole portion 625*a* and the heel end 627*a* in a statically loaded state, for example while standing still with the normal load of the athlete. The first curvature segment 622 branches of from the midfoot portion 640 in this example and may be reinforced. The constant radius of the first curvature segment 622 refers in this case to the inner radius. The radius may be equal or may be larger than the constant radius of the first curvature segment 632 of the forefoot spring. The length of the segments may again correspond to the forefoot spring and may be 90° as shown, but may be chosen differently compared to the forefoot spring, for example to adapt damping individually. The transition from portion A to portion B of the insole portion 621 at the forefoot spring is not divided into two equally long portions, but the posterior portion is somewhat longer. The transition from area A to B is arranged below the support point for the heel bone.

Figure 7A:
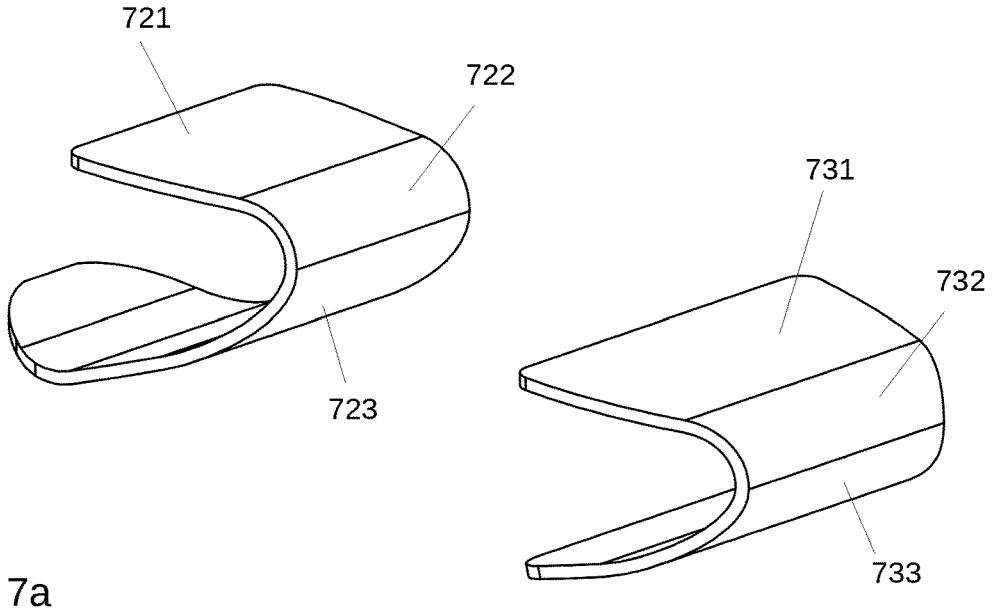
FIGS. 7A, 7B, and 7C show further examples of a separate heel spring and forefoot spring.
Figure 7B:
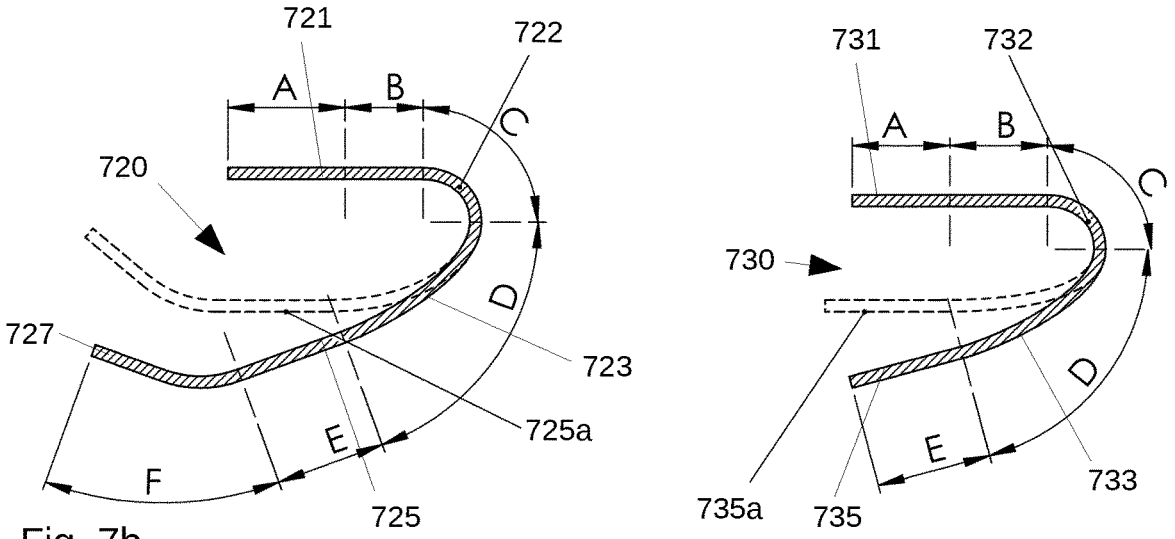
Figure 7C:
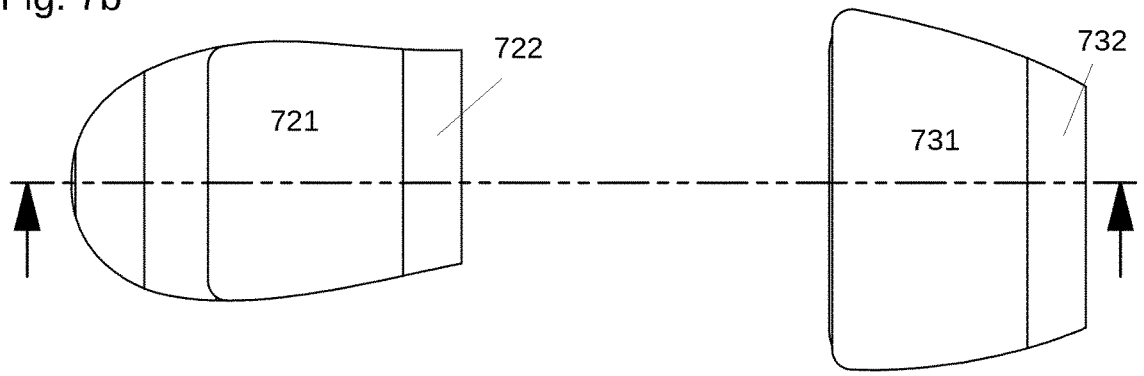

FIGS. 7A, 7B, and 7C show a forefoot spring 730 and heel spring 720, which are not connected to each other via a midfoot portion, but are formed as separate devices. They correspond in their design and function to the corresponding forefoot spring and heel spring of FIGS. 6A, 6B, and 6C and the corresponding description applies for the example of FIGS. 7A, 7B, and 7C. As a difference to FIGS. 6A, 6B, and 6C, however, the heel spring 720 and the forefoot spring 730 are separated in the beginning and may be arranged independently to an insole, for example by gluing. The spring elements can be individually positioned. The transmission of forces from the heel spring 720 to the forefoot spring 730 occurs through the insole (not shown) in this case. The forefoot spring can also be used alone, for example for running shoes for short or medium distances that are intended for forefoot strikes. No heel spring may be provided or the forefoot spring is combined with a different heel damper. It is also possible to use the heel spring 620 only or together with a different forefoot damping element.

The illustration and explanation of the examples shown describes embodiments of the present disclosure. A person skilled in the art will combine the examples and elements that are shown in some of the figures or examples with other examples where this is meaningful. The figures shown describe elements relevant to the disclosure in schematic ways and are intended for illustration. The examples shown are not to scale. Further elements may be used or added for implementation. A person skilled in the art may add elements typical for shoes without any additional effort. It is obvious, that additional elements that are common for shoes will be added, for example a leg or shaft connected to the insole. The leg or shaft may be a usual shaft and may comprise usual closing elements, such as laces or similar. An outsole with one or more elements may also be used. In addition, a protection for the spring element can be provided to protect the spaces between outsole portion and insole portion from stones or dirt.

The invention claimed is:

1. A spring device for a shoe for arrangement between an insole and an outsole, wherein the spring device comprises:
- a lower outsole portion; and
- an upper insole portion,
- wherein the lower outsole portion and the upper insole portion are connected via a continuous roll portion having a curvature,
- wherein the curvature comprises a continuously varying radius of curvature that increases towards the lower outsole portion according to a segment of at least one selected from the group of an elliptic or a parabolic curve,
- wherein the continuous roll portion is positioned so that the wearer rolls over the continuous roll portion during step in heel running; and
- wherein the upper insole portion comprises a plate, wherein the plate is substantially rigid so that the substantially rigid plate does not deform under load from the wearer.

2. The spring device of claim 1, wherein, in a statically loaded resting state, the upper insole portion and the lower outsole portion are arranged substantially parallel to each other.

3. The spring device of claim 1, wherein the spring device is a forefoot spring and is configured to be aligned at a shoe, such that the curvature faces towards a shoe tip.

4. The spring device of claim 1, wherein the spring device is a heel spring and is configured to be aligned at a shoe, such that the curvature faces towards a shoe end.

5. The spring device of claim 1,
- wherein the curvature comprises a first curvature,
- wherein the at least one section of the curvature includes a roll portion,
- wherein the first curvature has a constant radius of curvature, and
- wherein the radius of curvature in the roll portion increases elliptically or parabolically from the first curvature towards the lower outsole portion.

6. The spring device of claim 5, wherein the radius of curvature in the roll portion is in each point larger than the constant radius of curvature of the first curvature.

7. The spring device of claim 5, wherein the first curvature comprises, in a cross section, a segment of a circular curvature of 80 to 110°.

8. The spring device of claim 1, wherein the spring device is made from a multilayer fiver fiber composite material.

9. A damping device for a shoe for arrangement between a shaft portion and an outsole, wherein the damping device comprises a heel spring and a forefoot spring, which are connected to each other via an insole, wherein at least one selected from the group of the heel spring and the forefoot spring are a spring device, the spring device comprising:

a lower outsole portion; and an upper insole portion, wherein the lower outsole portion and the upper insole portion are connected via a continuous roll portion having a curvature, wherein the curvature comprises a continuously varying radius of curvature that increases towards the lower outsole portion according to a segment of at least one selected from the group of an elliptic curve and a parabolic curve, wherein the continuous roll portion is positioned so that the wearer rolls over the continuous roll portion during step in heel running; and wherein the upper insole portion comprises a plate, wherein the plate is substantially rigid so that the substantially rigid plate does not deform under load from the wearer.

10. The damping device of claim 9, wherein the forefoot spring and the heel spring are connected to each other via an elastically extendible outsole portion.

11. The damping device of claim 9, wherein the upper insole portion is configured to enable at least one of selected from the group of torsion and bending of the forefoot spring with respect to the heel spring.

12. A shoe, comprising: an insole;

an outsole; and at least one damping element arranged between the insole and the outsole, wherein the at least one damping element comprises at least one spring device, and wherein the at least one spring device comprises:

a lower outsole portion, and an upper insole portion, wherein the lower outsole portion and the upper insole portion are connected via a continuous roll portion having a curvature, wherein the curvature comprises a continuously varying radius of curvature that increases towards the lower outsole portion according to a segment of at least one of an elliptic curve and a parabolic curve, wherein the continuous roll portion is positioned so that the wearer rolls over the continuous roll portion during step in heel running; and wherein the upper insole portion comprises a plate, wherein the plate is substantially rigid so that the substantially rigid plate does not deform under load from the wearer.

13. The shoe of claim 12, further comprising:

a forefoot spring; and a heel spring, wherein an anterior damping element is arranged underneath a forefoot area of the shoe and a posterior damping element is arranged underneath a heel area of the shoe.

14. The shoe of claim 12, wherein one of the at least one spring device is a forefoot spring and is configured to be aligned at a shoe, such that the curvature faces towards a shoe tip.

15. The shoe of claim 12, wherein one of the at least one spring device is a heel spring and is configured to be aligned at the shoe, such that the curvature faces towards a shoe end.

16. The shoe of claim 12, wherein the curvature comprises a first curvature, wherein the at least one section of the curvature includes a roll portion, wherein the first curvature has a constant radius of curvature, and wherein the radius of curvature in the roll portion increases elliptically or parabolically from the first curvature towards the lower outsole portion.

17. The shoe of claim 12, wherein the at least one damping element comprises a heel spring and a forefoot spring, and wherein the lower outsole portion comprises an elastic ribbon arranged between a sole portion of the heel spring and a sole portion of the forefoot spring.

* * * * *